US009828819B2

(12) United States Patent
Bujold et al.

(10) Patent No.: US 9,828,819 B2
(45) Date of Patent: Nov. 28, 2017

(54) METHOD AND APPARATUS FOR DUAL INSTRUMENT INSTALLATION IN A WELLBORE

(71) Applicant: ATHABASCA OIL CORPORATION, Calgary (CA)

(72) Inventors: Maurice A Bujold, Cochrane (CA); Justin David MacDonald, Calgary (CA); Shane Daniel Lokszyn, Red Deer (CA)

(73) Assignee: ATHABASCA OIL CORPORATION, Calgary, Alberta (CA)

( * ) Notice: Subject to any disclaimer, the term of this patent is extended or adjusted under 35 U.S.C. 154(b) by 594 days.

(21) Appl. No.: 14/487,877

(22) Filed: Sep. 16, 2014

(65) Prior Publication Data

US 2015/0075819 A1 Mar. 19, 2015

Related U.S. Application Data

(60) Provisional application No. 61/880,071, filed on Sep. 19, 2013.

(51) Int. Cl.

| | |
|---|---|
| ***E21B 23/10*** | (2006.01) |
| ***E21B 47/01*** | (2012.01) |
| ***E21B 23/08*** | (2006.01) |

(52) U.S. Cl.

CPC ..... *E21B 23/08* (2013.01); *E21B 47/01* (2013.01)

(58) Field of Classification Search

CPC ..... E21B 23/08; E21B 47/01

See application file for complete search history.

(56) References Cited

U.S. PATENT DOCUMENTS

| | | | | |
|---|---|---|---|---|
| 4,457,370 | A * | 7/1984 | Wittrisch | E21B 23/08 166/254.2 |
| 4,485,870 | A * | 12/1984 | Walulik | E21B 17/003 166/250.17 |
| 6,116,085 | A | 9/2000 | Moffatt et al. | |
| 7,322,421 | B2 * | 1/2008 | Blacklaw | E21B 23/08 166/383 |
| 8,230,917 | B2 | 7/2012 | Boles et al. | |
| 9,523,254 | B1 * | 12/2016 | Barton | E21B 47/00 |
| 2004/0031319 | A1 | 2/2004 | Perales | |
| 2004/0163807 | A1 | 8/2004 | Vercaemer | |

(Continued)

OTHER PUBLICATIONS

International Search Report and Written Opinion of the International Searching Authority for corresponding PCT Application No. PCT/CA2014/050859, dated Nov. 28, 2014, completed on Nov. 24, 2014.

*Primary Examiner* — Robert E Fuller

(74) *Attorney, Agent, or Firm* — Heslin Rothenberg Farley & Mesiti P.C.; Victor A. Cardona, Esq.

(57) ABSTRACT

An apparatus for installing two sensing instruments and cables inside of a single tubing string in a wellbore for monitoring well conditions at two different locations includes an upper sensor attached to an inner sleeve seated at a first location in a ported outer sleeve in the tubing string. The upper sensor is allowed to be in pressure communication with the exterior of the tubing string at the first location. A second lower sensor is deployed on a pump down cup (PDC) assembly to a lower depth in the outer sleeve to allow fluid pressures to be monitored at a second location in the wellbore.

23 Claims, 12 Drawing Sheets

(56) References Cited

U.S. PATENT DOCUMENTS

| | | | | |
|---|---|---|---|---|
| 2010/0132955 | A1* | 6/2010 | Storm, Jr. | E21B 23/02 166/377 |
| 2011/0079401 | A1* | 4/2011 | Gambier | E21B 23/08 166/384 |
| 2011/0229071 | A1 | 9/2011 | Vincelette et al. | |
| 2011/0240301 | A1 | 10/2011 | Robison et al. | |
| 2013/0048380 | A1 | 2/2013 | Rasmus et al. | |
| 2014/0034310 | A1* | 2/2014 | Andersen | E21B 34/14 166/281 |
| 2014/0102723 | A1* | 4/2014 | Stair | E21B 23/08 166/386 |
| 2015/0330211 | A1* | 11/2015 | Kabatek | E21B 47/065 166/250.01 |

* cited by examiner

METHOD AND APPARATUS FOR DUAL INSTRUMENT INSTALLATION IN A WELLBORE

CROSS-REFERENCE TO RELATED APPLICATIONS

This application claims priority from U.S. provisional patent application No. 61/880,071, filed Sep. 19, 2013, the entire disclosure of which is incorporated herein by reference.

FIELD OF THE INVENTION

The invention relates to a method and apparatus for installing two or more instrumentation sensors and cables inside of a single tubing string in a wellbore for monitoring well conditions at two or more locations in the wellbore.

BACKGROUND OF THE INVENTION

In many oil and/or gas producing wells, it is essential to measure parameters such as pressure and temperature at different points in the wellbore for safety, efficiency and production reasons. Typically, as shown in FIG. 1, in the past and in particular within various deviated wells that may have both vertical and horizontal sections, this has been achieved in a well casing 1 by installing a lower sensor 2 deployed at the end of a cable 3 to a depth near the toe 4 of the wellbore inside a tubing string 5. In the past, in a typical scenario, an upper sensor 6 and cable 7 are clamped or banded onto the outside of a production tubing string 8 near the heel 9 of the wellbore.

During well servicing and other interventions that may be necessary throughout the life of a well, the production tubing string is often pulled out and re-installed at various times, which requires the upper sensor 6 and cable 7 that have been clamped to the outside of the production tubing string to be handled. Handling the sensor and cable adds to the complexity of each intervention and increases the time, costs, and the number of services involved in the intervention. Furthermore there is also a risk of damaging the sensor and cable during deployment and pulling of the production tubing string each time it is handled.

Moreover, by having the sensor and cable attached to the production tubing string, vibrations in the production tubing string created by pumps and other equipment can damage the sensor, resulting in inaccurate readings and/or the need to repair or replace the sensor.

A review of the prior art reveals several systems for measuring pressure in a wellbore. For example, U.S. Pat. No. 8,230,917 teaches a system and method for determining fluid invasion in reservoir zones using a sensor in coiled tubing. US 2004/0031319 teaches a system that displaces a predetermined fluid in order to measure pressure in a highly deviated or horizontal wellbore. US 2011/0229071 teaches a sensor system for taking measurements at a variety of locations in a wellbore using an optical fiber having a plurality of pressure sensors spaced apart on the optical fiber. US 2013/0048380 teaches a method for estimating one or more interval densities in a wellbore by acquiring first and second axially spaced pressure measurements in the wellbore using a tool string containing a number of spaced apart pressure sensors. U.S. Pat. No. 6,116,085 teaches a tubing string housing a plurality of pressure sensor assemblies connected to ports along the tubing string and a plurality of thermocouples operative to measure temperature at points along the tubing string in a wellbore.

In view of the foregoing, there is a need for an apparatus and method for deploying and installing instrumentation into a wellbore wherein subsequent handling of the instrumentation is minimized. There is also a need for an apparatus and method for deploying instrumentation to reduce vibrations on the instrumentation caused by pumps. There is a further need for an apparatus and method for deploying two or more instruments inside of a single tubing string, separate from the production tubing string, wherein measurements can be taken simultaneously at more than one location in the wellbore. There is also a need for such an apparatus and method to enable the monitoring of well conditions at more than one location in the wellbore that is simple to install.

SUMMARY OF THE INVENTION

In accordance with the invention, there is provided an apparatus for deploying at least two sensing instruments at different locations in a tubing string within a wellbore having an outer sleeve for operative connection to the tubing string; an inner sleeve connected to a first sensing instrument, the inner sleeve for engagement with the outer sleeve at a first location; and a pump down assembly connected to a second sensing instrument, the pump down assembly disengageably connected to the inner sleeve and moveable through the tubing string with the inner sleeve to the first location; wherein applying fluid pressure in the tubing string disengages the pump down assembly from the inner sleeve at the first location, and applying further fluid pressure in the tubing string moves the pump down assembly and the second sensing instrument through the tubing string to a second location.

In one embodiment, the first and second sensing instruments are pressure sensors and are in pressure communication at the first and second locations, respectively, with the exterior of the tubing string.

In one embodiment, the outer sleeve includes at least one outer sleeve port for enabling pressure communication between the first, sensing instrument and the exterior of the tubing string.

In another embodiment, the inner sleeve includes an inner sleeve port positioned adjacent the first sensing instrument and in pressure communication with the at least one outer sleeve port for enabling pressure communication between the first sensing instrument and the exterior of the outer sleeve.

In yet another embodiment, the inner sleeve further comprises an orifice located between the inner sleeve port and the first sensing instrument for enabling pressure communication between the first sensing instrument and the inner sleeve port.

In another embodiment, the system further comprises at least one seal located between the inner sleeve and the outer sleeve for sealing the first sensing instrument from the inside of the inner sleeve.

In a further embodiment, the interior of the outer sleeve further comprises a circumferential groove within which the at least one outer sleeve port is located, and wherein the groove defines a recess between the at least one outer sleeve port and the inner sleeve port for allowing fluid communication between the at least one outer sleeve port and the inner sleeve port regardless of the orientation of the inner sleeve port within the recess.

In yet another embodiment, the system further comprises a plurality of outer sleeve ports located in the circumferential groove, and the recess enables the plurality of outer sleeve ports to be in fluid communication with each other and with the inner sleeve port.

In one embodiment, the first and second sensing instruments are sensors for measuring fluid pressure and/or temperature.

In another embodiment, the pump down assembly is disengageably connected to the inner sleeve by a shear sub, and applying fluid pressure into the tubing string causes the shear sub to shear, disengaging the pump down assembly from the inner sleeve at the first location.

In a further embodiment, the pump down assembly includes a pump down cup for pumping the pump down assembly from the first location to the second location using fluid pressure.

In yet a still further embodiment, the pump down cup includes a heat dissolvable material. The heat dissolvable material may be urethane that melts at temperatures of around 100° C.

In another embodiment, the pump down cup includes a plurality of outwardly extending cups for engagement with the interior of the tubing string for enabling the pump down assembly to be pumped from the first location to the second location.

In a further embodiment, the pump down assembly further comprises a bullnose for guiding the pump down assembly through the tubing string. In one embodiment, the pump down assembly has an outer surface containing at least one groove for creating turbulence in a pumping fluid. In another embodiment, there are a plurality of longitudinal grooves in the pump down assembly outer surface.

In one embodiment, the first and second sensing instruments are attached to a first and second cable, respectively, that extend from the sensing instruments to a well surface.

In yet another embodiment, the outer sleeve further comprises a restriction at the second location for landing the pump down assembly at the second location in the tubing string.

In one embodiment, the system includes at least one perforation in the tubing string adjacent the second sensing instrument at the second location for enabling fluid communication between the second sensing instrument and the exterior of the tubing string.

In another aspect, the invention provides a method for deploying two sensing instruments at different locations in a tubing string within a wellbore comprising the steps of: a) operatively connecting an outer sleeve to a tubing string and running the outer sleeve and tubing string into the wellbore; b) running an inner sleeve and a pump down assembly down the tubing string, the inner sleeve connected to a first sensing instrument and the pump down assembly connected to a second sensing instrument, wherein the pump down assembly is disengageably connected to the inner sleeve; c) seating the inner sleeve and first sensing instrument in the outer sleeve at a first location in the tubing string; d) applying fluid pressure into the tubing string to disengage the pump down assembly from the inner sleeve at the first location; and e) applying further fluid pressure into the tubing string to pump the pump down assembly and second sensing instrument through the tubing string from the first location to a second location; wherein the first and second sensing instruments are in pressure communication with the exterior of the tubing string at the first and second locations, respectively.

In another embodiment, in step d), the pump down assembly is disengaged from the inner sleeve by shearing.

BRIEF DESCRIPTION OF THE DRAWINGS

The invention is described with reference to the accompanying figures in which.

DETAILED DESCRIPTION OF THE INVENTION

With reference to the figures, a dual instrumentation apparatus 10 and method of deploying the apparatus in a wellbore are described.

Figure 1:
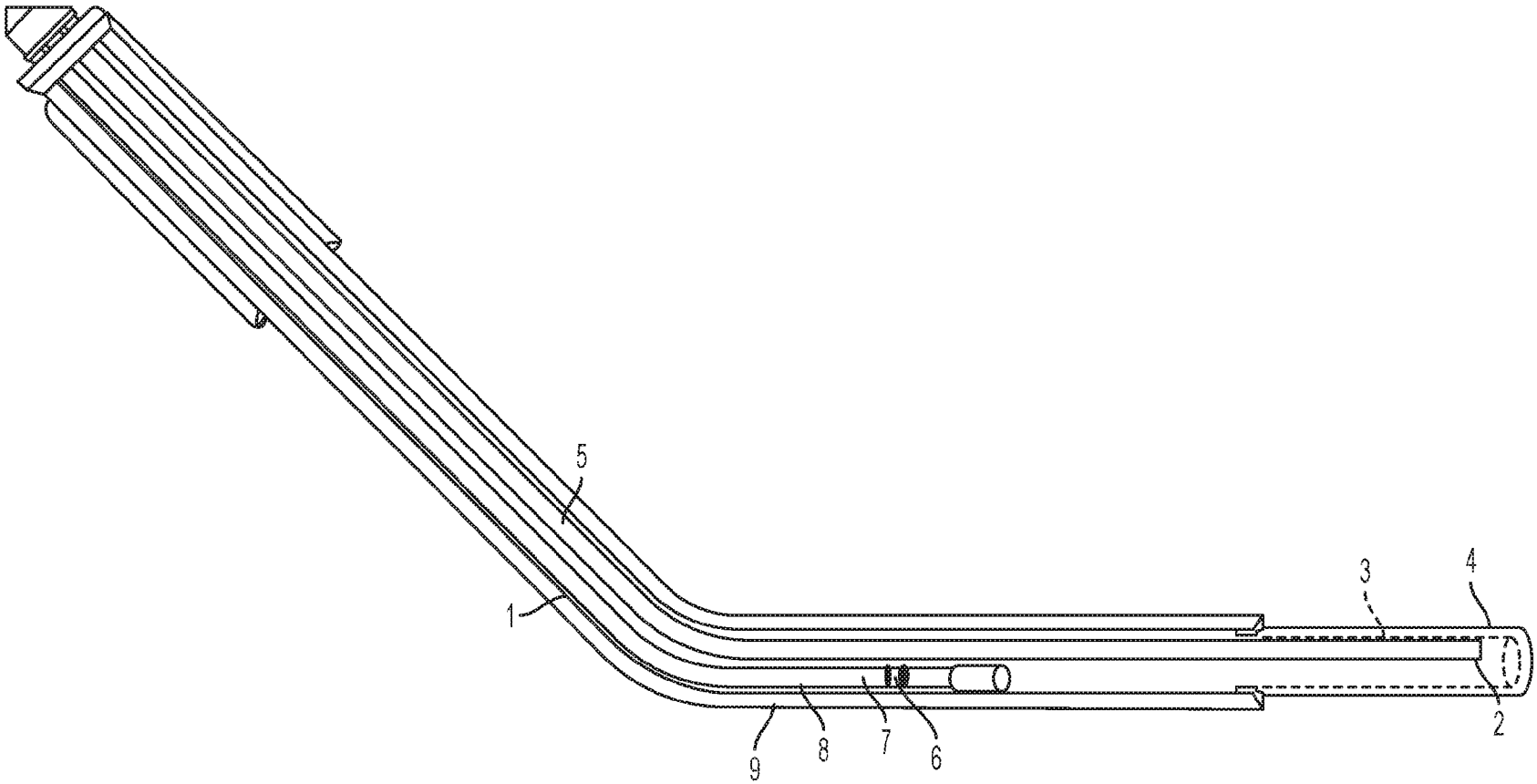
FIG. 1 PRIOR ART
FIG. 1 is a schematic of a horizontal wellbore illustrating a typical dual sensor installation in accordance with the prior art.
Figure 2:
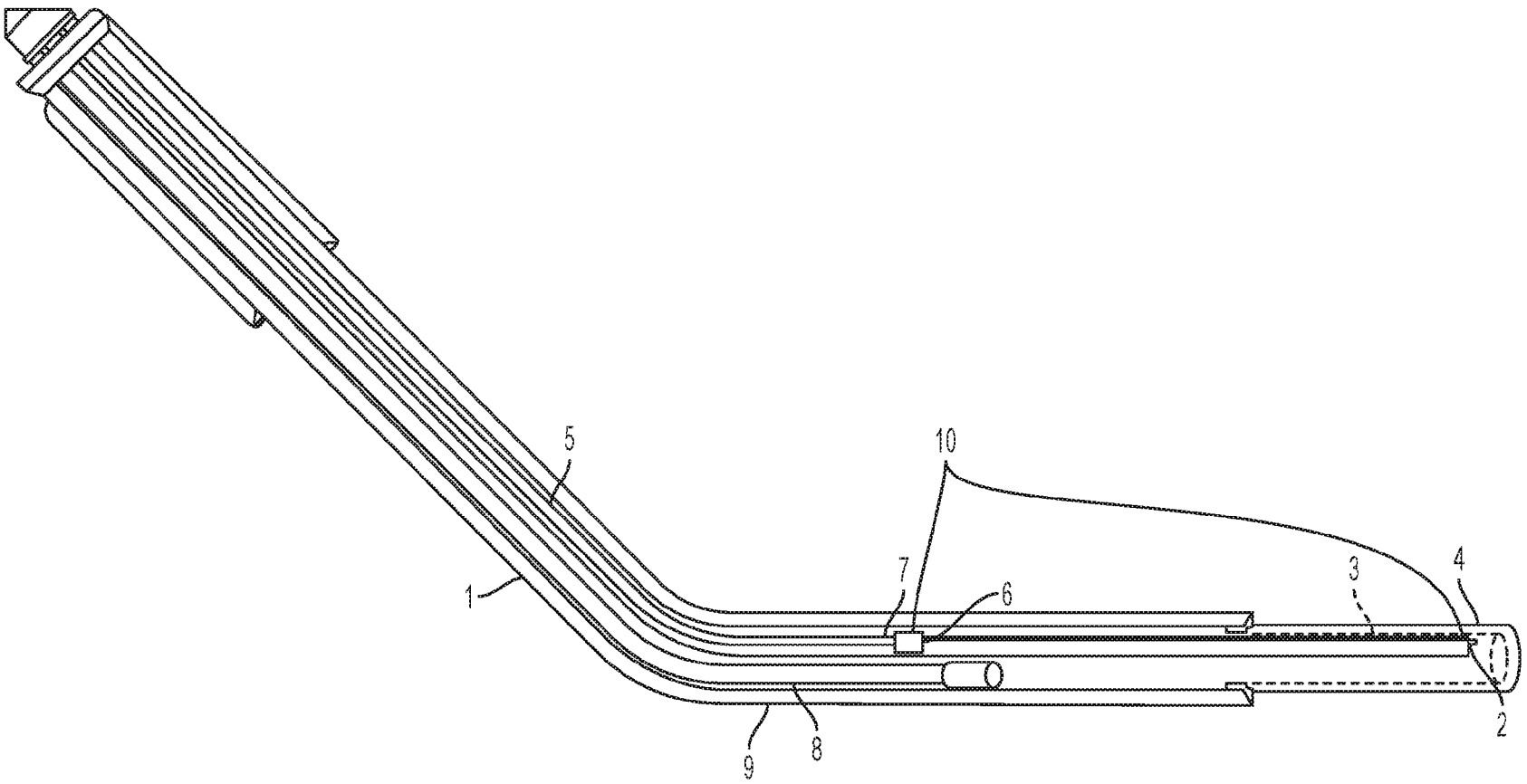
FIG. 2 is a schematic of a horizontal wellbore illustrating a dual sensor installation scenario in accordance with one embodiment of the invention.

FIG. 2 is a schematic of a horizontal wellbore 1 showing one embodiment of the dual instrumentation apparatus 10.

The apparatus 10, contained within a well casing 1, comprises a tubing string 5 containing two cables 3, 7 containing wires that extend from instrumentation at the surface of the well to a lower sensor 2 and an upper sensor 6 in the apparatus. In FIG. 2, the upper sensor 6 is located near the heel 9 of the wellbore at a first location, and the lower sensor 2 is positioned further downhole at a second location near the toe 4 of the wellbore. In alternate embodiments, the upper and lower sensors may be positioned at other locations in the wellbore. For example, the lower sensor may be located further uphole instead of at the end of the tubing string. Alternatively, the lower sensor may be positioned out the end of the tubing string.

FIG. 2 illustrates the dual instrumentation apparatus installed in a horizontal wellbore, however the apparatus can also be installed in other types of wellbores such as vertical and deviated wellbores.

Figure 3:
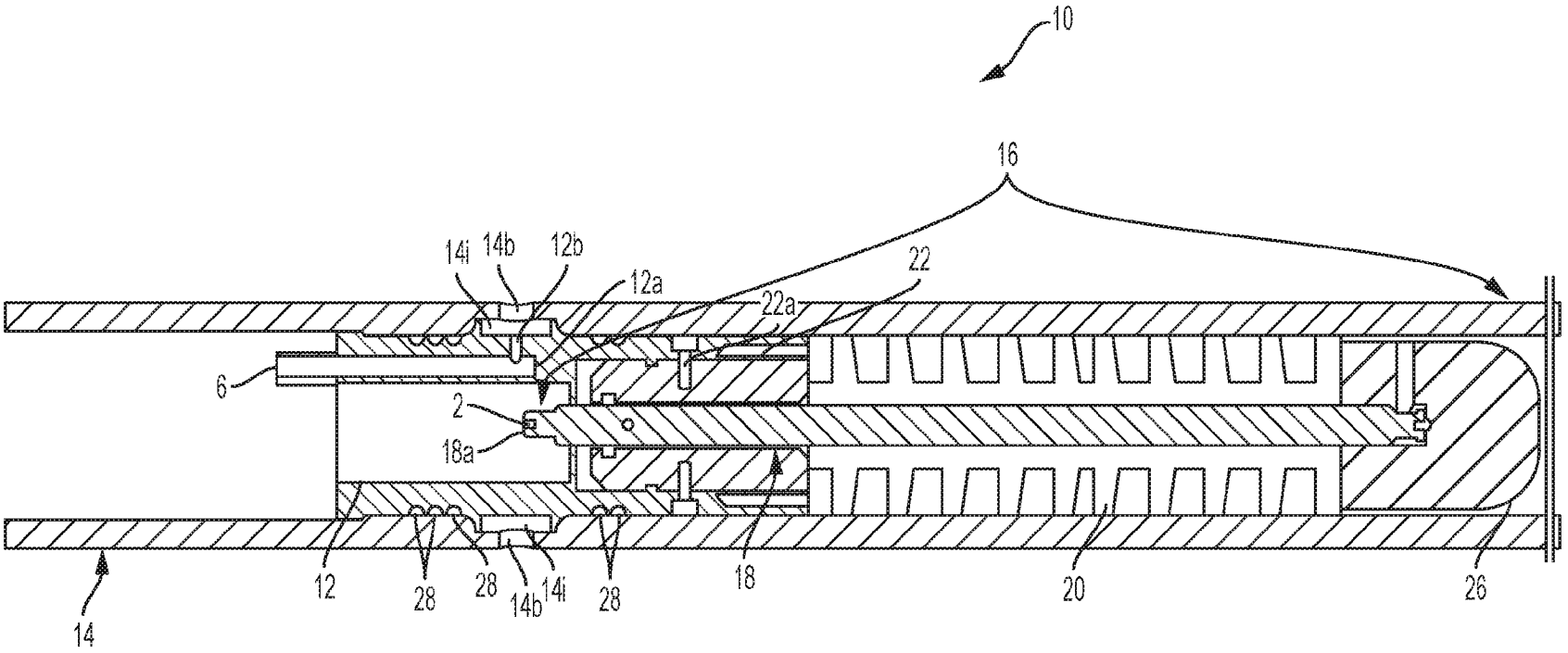
FIG. 3 is a cross-sectional side view of a dual instrumentation apparatus with an inner sleeve seated in an outer sleeve, and a pump down cup assembly (PDC) in the run-in position wherein the pump down cup assembly is attached to the inner sleeve at a first location in the tubing string in accordance with one embodiment of the invention.

Referring to FIG. 3, the apparatus comprises an inner sleeve 12 seated inside an outer sleeve, which is integral with the utility tubing, and a pump down cup (PDC) assembly 16 attached to the inner sleeve. The entire PDC assembly is moveable between a run-in position, shown in FIG. 3, and a set position, shown in FIGS. 4 and 11. The upper sensor 6 is attached to the inner sleeve, and the lower sensor is retained on the PDC assembly.

Outer Sleeve

Figure 5:
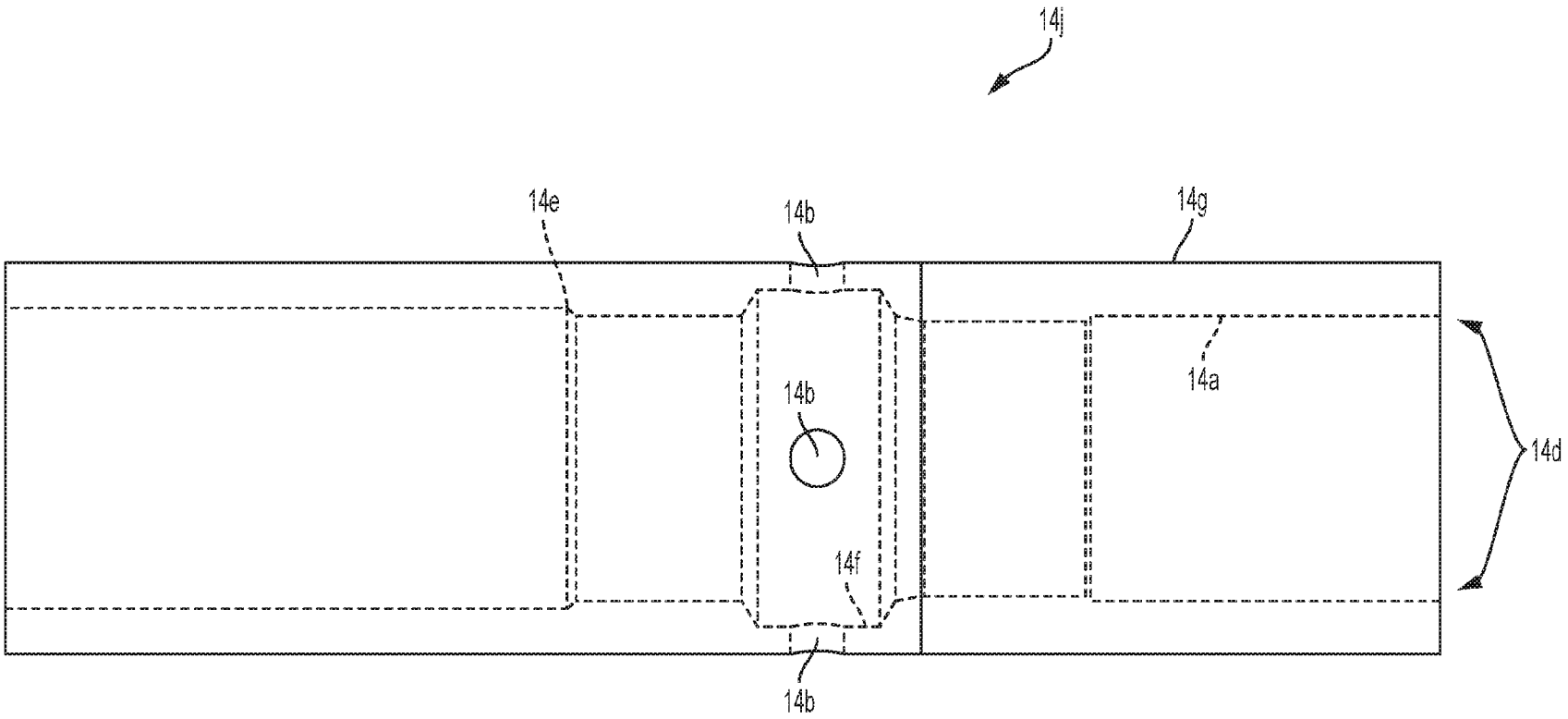
FIG. 5 is a side view of the outer sleeve at the first location in the tubing string with the internal profile illustrated in accordance with one embodiment of the invention.

Referring to FIG. 5, outer sleeve includes an outer surface 14*g*, an inner surface 14*a* defining a cavity 14*d*, a plurality of ports 14*b*, an inner shoulder 14*e*, and a groove 14*f*.

The outer sleeve inner shoulder 14*e* is located on the inner surface 14*a* of the cavity 14*d* to provide a landing point for the inner sleeve 12. The ports 14*b* extend through the outer sleeve around the outer sleeve circumference in the groove 14*f*. When the inner sleeve is landed in the outer sleeve, the groove 14*f* creates a recess 14*i* (shown in FIGS. 3 and 4) between the inner and outer sleeves to allow all the ports 14*b* to be in pressure communication with each other and with a port 12*b* on the inner sleeve. The groove and recess allow the inner sleeve port to be orientated in any manner within the recess and be in fluid communication with all the outer sleeve ports. The multiple ports also ensure fluid communication between the upper sensor and the exterior of the outer sleeve is maintained in the event that one or more of the ports 14*b* becomes plugged.

Inner Sleeve

Figure 6B:
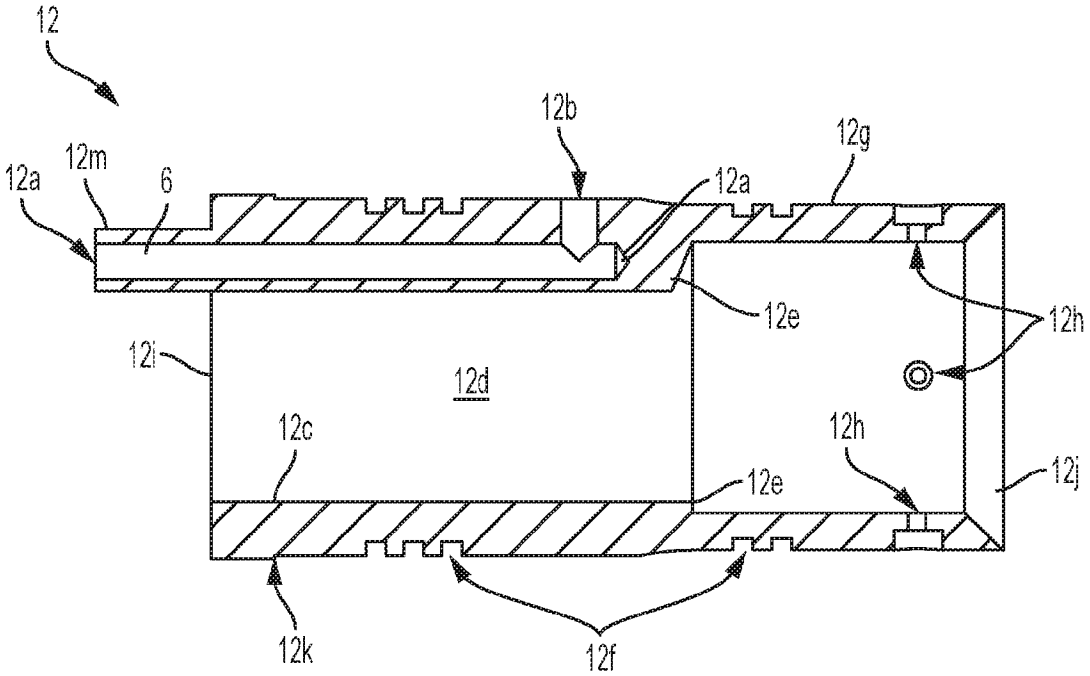
FIG. 6B is a cross-sectional side view of the inner sleeve at 6B-6B of FIG. 6A in accordance with one embodiment of the invention.
Figure 6A:
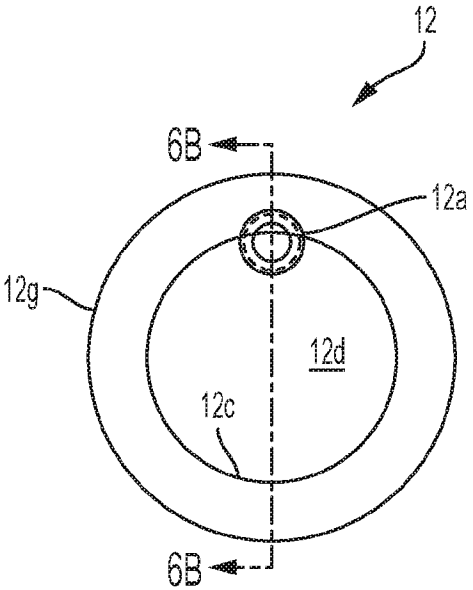
FIG. 6A is a top view of the inner sleeve showing the orifice and the upper sensor at the first location in the tubing string in accordance with one embodiment of the invention.

Referring to FIGS. 6A and 6B, the inner sleeve 12 includes an outer surface 12*g*, an inner surface 12*c* defining a cavity 12*d*, an upper end 12*i*, a lower end 12*j*, an orifice 12*a*, a port 12*b*, an inner shoulder 12*e*, an outer shoulder 12*k*, seal recesses 12*f*, retainer holes 12*h*, and a protrusion 12*m*.

The orifice 12*a* extends longitudinally from the inner sleeve upper end between the outer surface and the inner surface. The upper sensor 6 is connected to an upper end 12*m* of the orifice and is in sealing engagement with the orifice. In one embodiment, shown in FIG. 6B, the orifice extends beyond the upper end of the inner sleeve for ease of connection of the upper sensor. That is, the extension of the orifice upper end allows the upper sensor and cable to be threaded (for example) onto the extension using a wrench or similar device.

The port 12*b* extends from the orifice to the outer surface of the inner sleeve to allow the upper sensor to be in pressure communication with the exterior of the outer sleeve. The seal recesses 12*f* are located in the outer surface of the inner sleeve and contain sealing elements 28, such as O-rings, to seal the port and upper sensor from the inside of the inner and outer sleeves. The outer shoulder 12*k*, located on the outer surface of the inner sleeve, abuts with the outer sleeve inner shoulder 14*e* for landing the inner sleeve 12 within the outer sleeve 14 at the first location. The inner shoulder, located on the inner surface of the inner sleeve, allows for a shear sub 22 (described below) to be positioned in the inner sleeve cavity. The shear sub is affixed within the cavity using shear pins or screws that are installed through the inner sleeve retainer holes 12*h* and corresponding shear sub retainer holes.

Pump Down Cup (PDC) Assembly

Figure 4:
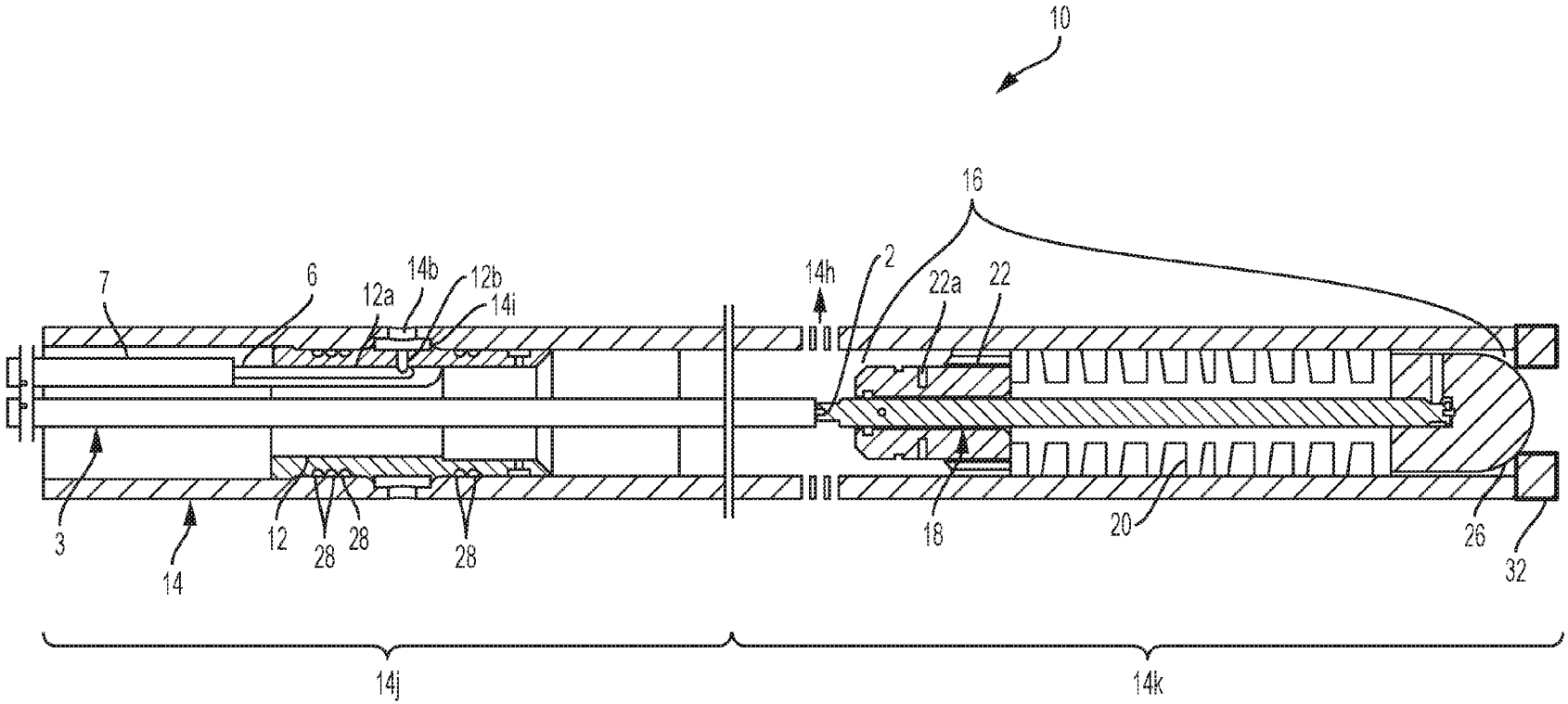
FIG. 4 is a cross-sectional side view of a dual instrumentation apparatus with the inner sleeve seated in the outer sleeve, and the pump down cup assembly in the set position wherein it has been released from the inner sleeve and pumped to a second location in the tubing string in accordance with one embodiment of the invention.

Referring to FIGS. 3 and 4, the PDC assembly 16 includes a PDC mandrel 18, a PDC 20, a shear sub 22, and a retainer nut 26.

Figure 8:
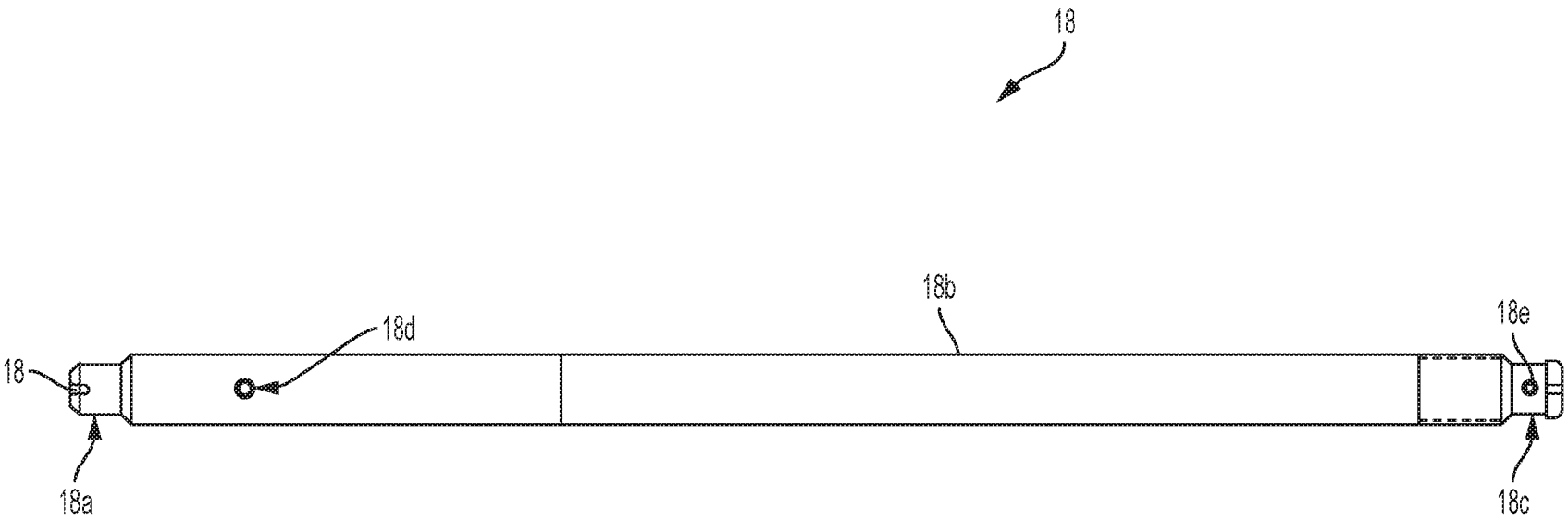
FIG. 8 is a side view of the pump down cup (PDC) mandrel in accordance with one embodiment of the invention.

Referring to FIG. 8, the PDC mandrel 18 is the core of the PDC assembly 16 and includes an upper end 18*a*, a central region 18*b* a lower end 18*c*, an upper hole 18*d* and a lower hole 18*e*. Preferably, the lower sensor 2 is threaded onto the upper end of the mandrel. The shear sub 22 is retained on the central region 18*b*, near the upper end 18*a*, and held in place using pins or screws inserted through the upper hole 18*d*. The PDC 20 is also retained on the central region, below the shear sub 22. The retainer nut 26 is connected to the lower end 18*c* of the PDC mandrel and held in place using pins or screws inserted through the lower hole 18*e*.

Figure 7B:
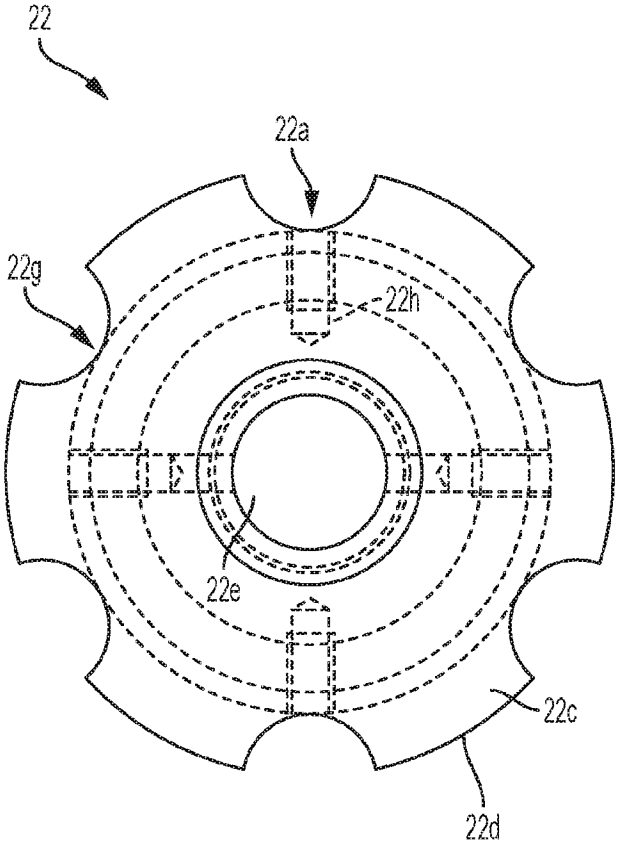
FIG. 7B is a bottom view of the shear sub with the internal profile illustrated in accordance with one embodiment of the invention.
Figure 7A:
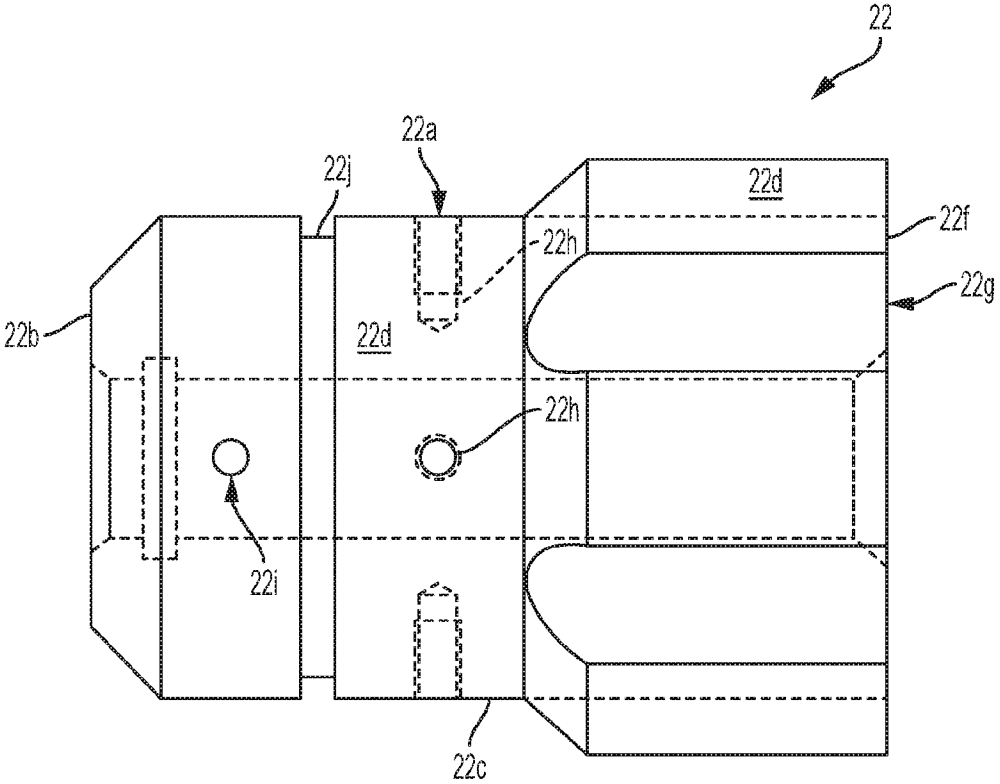
FIG. 7A is a side view of a shear sub with an internal profile illustrated in accordance with one embodiment of the invention.

Referring to FIGS. 7A and 7B, the shear sub 22 of the PDC assembly includes a sleeve 22*c* having an outer surface 22*d*, an internal bore 22*e*, an upper end 22*b*, a lower end 22*f*, longitudinal grooves 22*g*, shear pins 22*a* retained within shear pin holes 22*h*, a retainer hole 22*i*, and a shear sub seal groove 22*j*. At least a portion of the shear sub is retained within the inner sleeve 12 when the PDC assembly is in the run-in position at the first location in the outer sleeve, and the shear pins 22*a* extend into the inner sleeve retainer holes 12*h*. When pressure is applied to the shear sub upper end 22*b*, the shear pins 22*a* shear, releasing the shear sub from the inner sleeve and allowing the entire PDC assembly and lower sensor 2 to be pumped downhole into the set position at the second location. The longitudinal grooves 22*g* on the shear sub outer surface 22*d* create turbulence in the pump fluid to aid in pumping the PDC assembly downhole. The PDC mandrel 18 is inserted into the shear sub internal bore 22*e* and secured in place using pins or screws extending through the shear sub retainer hole 22*i*. The shear sub seal groove 22*j* is located upstream of the shear pins 22*a* and contains a shear sub seal (not shown) for preventing fluid leakage around the shear sub outer surface when the PDC assembly is in the run-in position.

Figure 9:
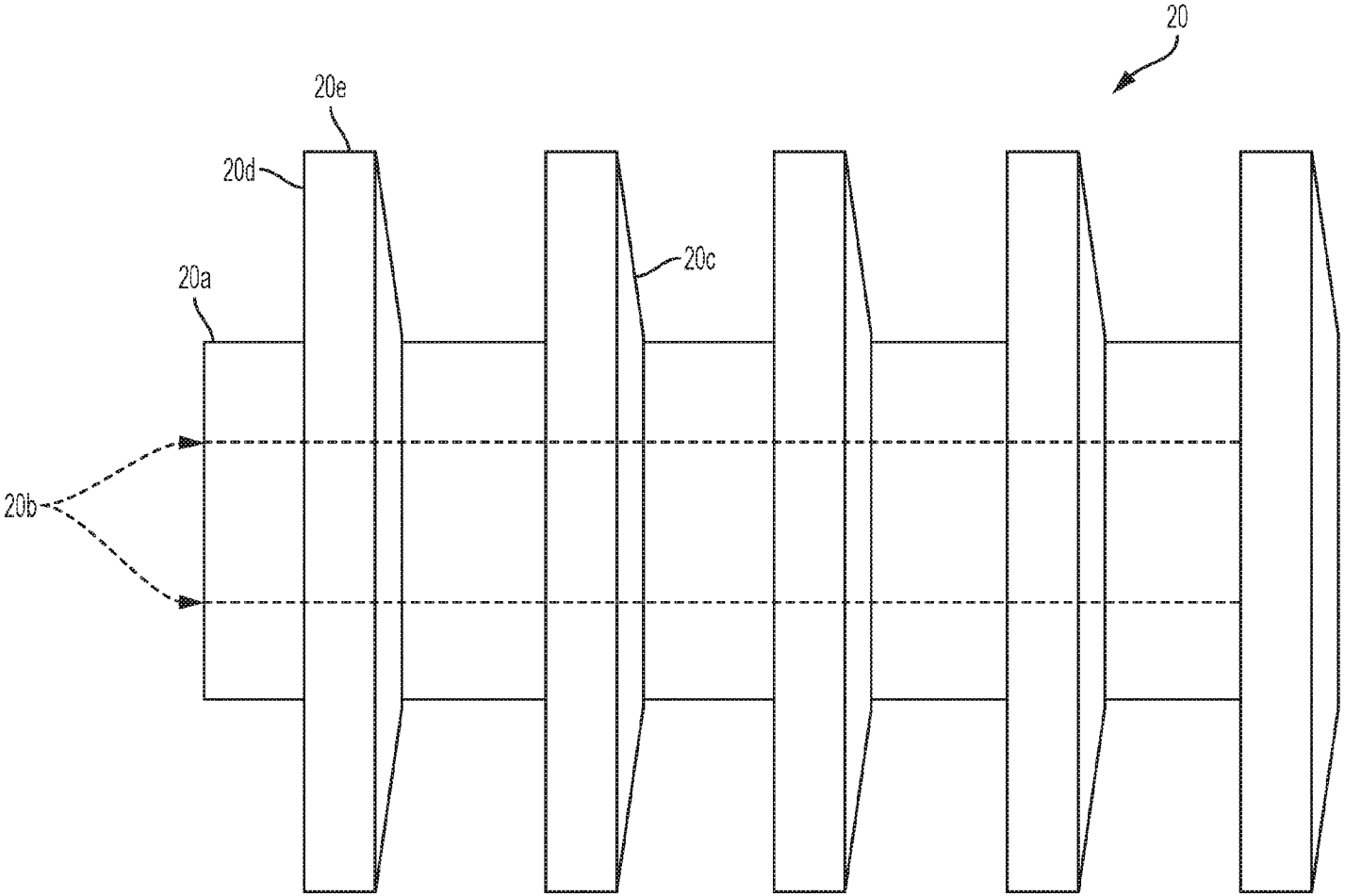
FIG. 9 is a side view of the pump down cup (PDC) with the internal profile illustrated in accordance with one embodiment of the invention.

Referring to FIG. 9, the PDC 20 includes a sleeve 20*a* having an inner bore 20*b* and a plurality of cups 20*c* each having an upper surface 20*d* and an outer surface 20*c*. The PDC is used to pump the PDC assembly downhole after the shear sub has sheared by applying fluid pressure onto the upper surface 20*d* of the cups 20*c*, pushing the PDC assembly downhole. The outer surface of each cup is in engagement with the outer sleeve inner surface 14*a* during run-in of the dual instrumentation apparatus, and then in engagement with the internal diameter of the tubing string after the PDC assembly has been sheared from the inner mandrel with pump pressure and is being pumped downhole. Other shapes and configurations for the PDC may be used as would be known to one skilled in the art. In one embodiment, a portion of the PDC is made from a material that melts or dissolves at high temperatures to enable subsequent fluid flow around the PDC if desired. In this embodiment, a portion of the PDC comprises a dissolvable material such as urethane may be incorporated, which melts at a temperature of 108° C.

Figure 10B:
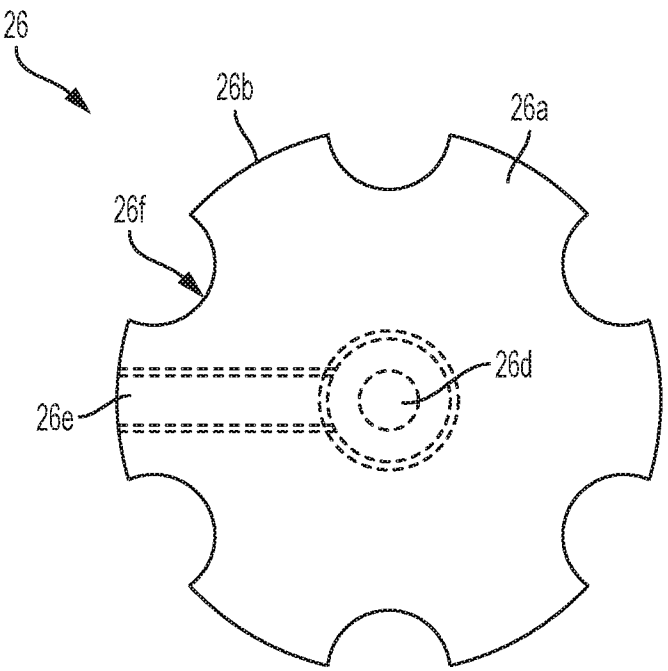
FIG. 10B is a bottom view of the retainer nut with the internal profile illustrated in accordance with one embodiment of the invention.
Figure 10A:
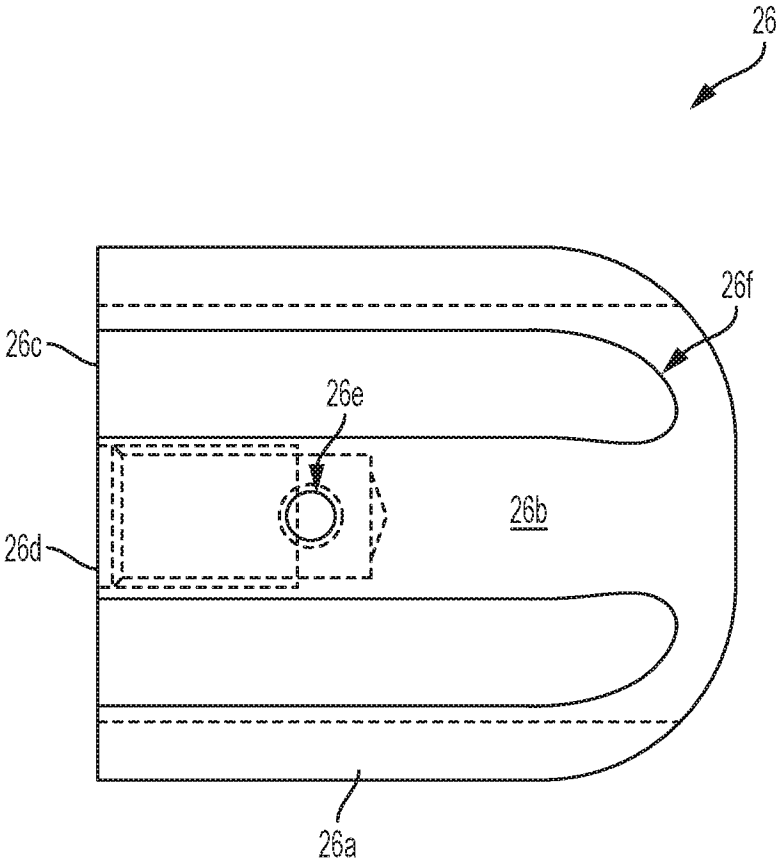
FIG. 10A is a side view of a retainer nut with the internal profile illustrated in accordance with one embodiment of the invention.

Referring to FIGS. 10A and 10B, the PDC retainer nut 26 includes a body 26*a* having an outer surface 26*b*, a bore 26*d*, an upper end 26*c*, a bull nose 26*g*, a retainer hole 26*e*, and a plurality of grooves 26*f*. The PDC mandrel 18 is inserted into the bore 26*d* and attached via a pin or screw inserted through a hole 26*e* in the retainer nut body that lines up with the PDC mandrel lower hole 18*e*. The bull nose 26*g* guides the PDC assembly down the tubing string and provides protection for the rest of the PDC assembly and lower sensor. Similar to the shear sub 22, the PDC retainer nut grooves 26*f* create turbulence in the pump-down fluid to aid in the pumping down process in order to move the PDC assembly from the run-in position to the set position, and from the first location to the second location in the tubing string.

Setting the Pump Down Cup (PDC) Assembly

Figure 11:
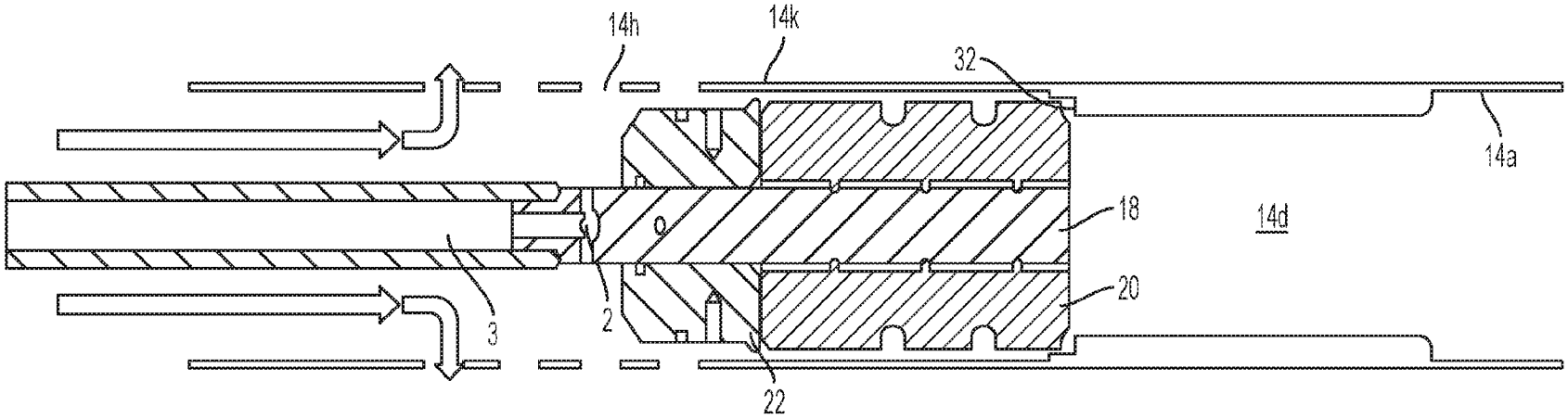
FIG. 11 is a cross-sectional side view of the PDC assembly in the set position at the second location in the tubing string, showing the flow of pump down fluid from the interior to the exterior of the outer sleeve in accordance with one embodiment of the invention.
Figure 12:
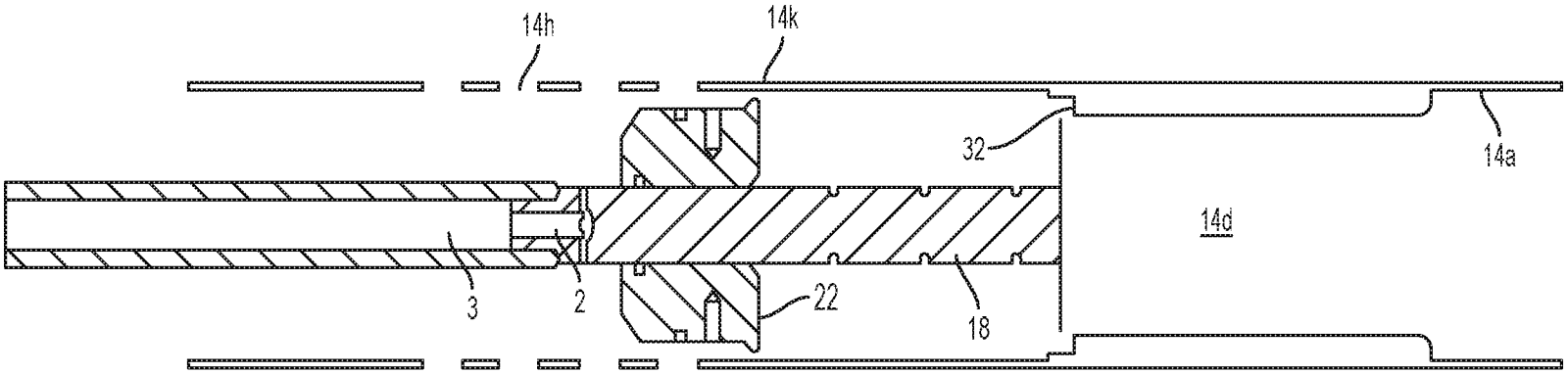
FIG. 12 is a cross-sectional side view of the PDC assembly in the set position at the second location in the tubing string after the PDC has dissolved in accordance with one embodiment of the invention.

FIGS. 11 and 12 illustrate a lower section 14*k* of the tubing string wherein the PDC assembly and the lower sensor are set at the second location. The lower section 14*k* of the tubing string is a specialized section or sleeve that includes a restriction in the tubing string that prevents the PDC assembly from going past the desired location and that includes perforations to permit fluid flow through the lower section 14*k*. In one embodiment, the restriction is an internal diameter restriction in the tubing string. In another embodiment, there is a bar (not shown), such as a tag bar, extending across the internal cavity of the tubing string to act as a restriction. Other suitable mechanisms for setting the PDC assembly and lower sensor at the desired location are known to one skilled in the art.

As noted above, the lower section 14*k* of the tubing string also includes perforations 14*h* for allowing the lower sensor to be in fluid and pressure communication with the exterior of the tubing string.

Method

In operation, the tubing string is prepared by connecting the lower section 14*k* to the end of the tubing string as well as connecting the outer sleeve 14 to the tubing string at a desired position. The tubing string is run into a wellbore, typically such that the lower section 14*k* is adjacent the toe and the outer sleeve 14 is adjacent the heel of the wellbore thereby defining the first and second positions. At the well surface. the upper sensor cable 7 and upper sensor 6 are attached in the inner sleeve orifice 12*a*, and the lower sensor 2 and lower sensor cable 3 are attached to the PDC mandrel 18. The PDC assembly is connected to the inner sleeve, and the inner sleeve and PDC assembly are pumped into the tubing string until they land at the first location in the outer sleeve, Upon seating of the inner sleeve in the outer sleeve, pumping fluid pressure is increased, shearing the shear sub 22 and releasing the PDC assembly from the inner sleeve. Pumping is continued, causing the PDC assembly and attached lower sensor 2 and cable 3 to move downhole to the second location where the restriction 32 prevents the PDC assembly from moving beyond the desired depth/location. Upon seating the PDC assembly in the outer sleeve at the second location, pumping is stopped and the PDC is now in the set position at the second location. The pump down fluid flows out of the outer sleeve cavity 14*d* through the perforations 14*h* where it is pumped back to the surface for recovery.

In one embodiment, after the PDC assembly has reached the desired depth/location and is in the set position, high temperature fluid or steam is injected into the tubing string to cause the PDC to melt or dissolve. FIG. 12 illustrates the PDC assembly in the set position after the PDC has melted/dissolved.

Alternative Uses for the Dual Instrumentation Apparatus

While the dual instrumentation apparatus has been described as deploying an upper and lower sensor for measuring pressure and temperature of wellbore fluid, the apparatus may be used for other purposes. For example, the apparatus can be used to inject substances into the well at different depths. Instead of cables containing wires attached to sensors there are hollow cables into which chemicals or other substances are injected that would then be introduced to different depths in the wellbore. In another embodiment, instead of measuring pressure at a first and second location using sensors and cables, "bubble tubes" are used to monitor downhole pressure at the first and second location. Bubble tubes, as known to one skilled in the art, are hollow cables that allow pressure access from one end of the tube to the other end of the tube.

In a further embodiment, the apparatus can be used for taking fluid samples from different depths in the well. Again, in this embodiment the system would not include sensors but rather just hollow cables.

Although the present invention has been described and illustrated with respect to preferred embodiments and preferred uses thereof, it is not to be so limited since modifications and changes can be made therein which are within the full, intended scope of the invention as understood by those skilled in the art.

The invention claimed is:

1. An apparatus for deploying at least two sensing instruments at different locations in a tubing string within a wellbore comprising:

an outer sleeve for operative connection to the tubing string;

an inner sleeve connected to a first sensing instrument, the inner sleeve for engagement with the outer sleeve at a first location; and a pump down assembly connected to a second sensing instrument, the pump down assembly disengageably connected to the inner sleeve and moveable through the tubing string with the inner sleeve to the first location;

wherein applying fluid pressure in the tubing string disengages the pump down assembly from the inner sleeve at the first location, and applying further fluid pressure in the tubing string moves the pump down assembly and the second sensing instrument through the tubing string to a second location.

2. The apparatus of claim 1 wherein the first and second sensing instruments are pressure sensors and are in pressure communication at the first and second locations, respectively, with the exterior of the tubing string.

3. The apparatus of claim 1 wherein the outer sleeve includes at least one outer sleeve port for enabling pressure communication between the first sensing instrument and the exterior of the tubing string.

4. The apparatus of claim 3 wherein the inner sleeve includes an inner sleeve port positioned adjacent the first sensing instrument and in pressure communication with the at least one outer sleeve port for enabling pressure communication between the first sensing instrument and the exterior of the outer sleeve.

5. The apparatus of claim 4 wherein the inner sleeve further comprises an orifice located between the inner sleeve port and the first sensing instrument for enabling pressure communication between the first sensing instrument and the inner sleeve port.

6. The apparatus of claim 4 wherein the interior of the outer sleeve further comprises a circumferential groove within which the at least one outer sleeve port is located, and wherein the groove defines a recess between the at least one outer sleeve port and the inner sleeve port for allowing fluid communication between the at least one outer sleeve port and the inner sleeve port regardless of the orientation of the inner sleeve port within the recess.

7. The apparatus of claim 6 further comprising a plurality of outer sleeve ports located in the circumferential groove, and wherein the recess enables the plurality of outer sleeve ports to be in fluid communication with each other and with the inner sleeve port.

8. The apparatus of claim 1, further comprising at least one seal located between the inner sleeve and the outer sleeve for sealing the first sensing instrument from the inside of the inner sleeve.

9. The apparatus of claim 1, wherein the first and second sensing instruments are sensors for measuring fluid pressure and/or temperature.

10. The apparatus of claim 1, wherein the pump down assembly is disengageably connected to the inner sleeve by a shear sub, and applying fluid pressure into the tubing string causes the shear sub to shear, disengaging the pump down assembly from the inner sleeve at the first location.

11. The apparatus of claim 1, wherein the pump down assembly includes a pump down cup for pumping the pump down assembly from the first location to the second location using fluid pressure.

12. The apparatus of claim 11 wherein the pump down cup includes a heat dissolvable material.

13. The apparatus of claim 11 wherein the heat dissolvable material is urethane that melts at temperatures of around 100° C.

14. The apparatus of claim 11, wherein the pump down cup includes a plurality of outwardly extending cups for engagement with the interior of the tubing string for enabling the pump down assembly to be pumped from the first location to the second location.

15. The apparatus of claim 1, wherein the pump down assembly further comprises a bullnose for guiding the pump down assembly through the tubing string.

16. The apparatus of claim 1, wherein the pump down assembly has an outer surface containing at least one groove for creating turbulence in a pumping fluid.

17. The apparatus of claim 16 wherein there are a plurality of longitudinal grooves in the pump down assembly outer surface.

18. The apparatus of claim 1, wherein the first and second sensing instruments are attached to a first and second cable, respectively, that extend from the sensing instruments to a well surface.

19. The apparatus of claim 1, wherein the outer sleeve further comprises a restriction at the second location for landing the pump down assembly at the second location in the tubing string.

20. The apparatus of claim 1, further comprising at least one perforation in the tubing string adjacent the second sensing instrument at the second location for enabling fluid communication between the second sensing instrument and the exterior of the tubing string.

21. A method for deploying two sensing instruments at different locations in a tubing string within a wellbore comprising the steps of:

a) operatively connecting an outer sleeve to a tubing string and running the outer sleeve and tubing string into the wellbore;

b) running an inner sleeve and a pump down assembly down the tubing string, the inner sleeve connected to a first sensing instrument and the pump down assembly connected to a second sensing instrument, wherein the pump down assembly is disengageably connected to the inner sleeve;

c) seating the inner sleeve and first sensing instrument in the outer sleeve at a first location in the tubing string;

d) applying fluid pressure into the tubing string to disengage the pump down assembly from the inner sleeve at the first location; and e) applying further fluid pressure into the tubing string to pump the pump down assembly and second sensing instrument through the tubing string from the first location to a second location;

wherein the first and second sensing instruments are in pressure communication with the exterior of the tubing string at the first and second locations, respectively.

22. The method of claim 21 wherein in step d), the pump down assembly is disengaged from the inner sleeve by shearing.

23. The method of claim 21, further comprising the step of:

f) injecting steam into the tubing string to cause at least a portion of the pump down assembly to melt.

* * * * *